US010479595B2

(12) United States Patent
Cailleaux

(10) Patent No.: US 10,479,595 B2
(45) **Date of Patent: *Nov. 19, 2019**

(54) CONTAINER WITH IMPROVED CLOSING MECHANISM

(71) Applicant: PHILIP MORRIS PRODUCTS S.A., Neuchatel (CH)

(72) Inventor: Timothee Cailleaux, Divonne-les-Bains (FR)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/737,828

(22) PCT Filed: Aug. 26, 2016

(86) PCT No.: PCT/EP2016/070254
§ 371 (c)(1),
(2) Date: Dec. 19, 2017

(87) PCT Pub. No.: WO2017/036991
PCT Pub. Date: Mar. 9, 2017

(65) Prior Publication Data

US 2019/0002190 A1 Jan. 3, 2019

(30) Foreign Application Priority Data

Aug. 28, 2015 (EP) ..... 15182996

(51) Int. Cl.
*B65D 85/10* (2006.01)

(52) U.S. Cl.
CPC ..... *B65D 85/1045* (2013.01); *B65D 2313/06* (2013.01)

(58) Field of Classification Search
CPC .. B65D 5/0281; B65D 75/58; B65D 75/5838; B65D 85/10; B65D 85/1036; B65D 85/1045; B65D 85/1081; B65D 2313/06
(Continued)

(56) References Cited

U.S. PATENT DOCUMENTS 7,731,024 B2 * 6/2010 Bouno ..... A24F 15/12 206/268
8,567,598 B2 * 10/2013 Gibson ..... B65D 5/6691 206/268

(Continued)

FOREIGN PATENT DOCUMENTS

CN 101102945 1/2008
CN 204507761 7/2015

(Continued)

OTHER PUBLICATIONS

European Extended Search Report for Application No. 15182996.7 dated Dec. 1, 2015 (7 pages).

(Continued)

*Primary Examiner* — Bryon P Gehman
(74) *Attorney, Agent, or Firm* — Mueting, Raasch & Gebhardt, P.A.

(57) ABSTRACT

A container (100) for consumer goods, the container comprising a housing (20) having an opening for accessing the consumer goods; and a lid (40) connected to the housing and movable relative to the housing (20) between a closed position in which the lid (40) covers the opening and an open position in which the opening is uncovered. A first surface of the lid is disposed adjacent to a first surface of the housing when the lid is in the closed position, and wherein a microsuction structure (244) is provided on the first surface of the lid, the first surface of the housing, or both the first surface of the lid and the first surface of the housing, for (Continued)

retaining the lid (40) in the closed position relative to the housing (20).

13 Claims, 2 Drawing Sheets

(58) Field of Classification Search
USPC ..... 206/264–270
See application file for complete search history.

(56) References Cited

U.S. PATENT DOCUMENTS

| | | | | |
|---|---|---|---|---|
| 9,132,605 | B2 * | 9/2015 | Nguyen | C09J 7/00 |
| 10,258,082 | B2 * | 4/2019 | Suss | A24F 23/02 |
| 2012/0319320 | A1 | 12/2012 | Sitti | |
| 2015/0041346 | A1 * | 2/2015 | Seyfferth De Oliveira | B65D 85/1045 206/268 |
| 2015/0305402 | A1 * | 10/2015 | Bourgoin | B65D 5/6691 206/265 |

FOREIGN PATENT DOCUMENTS

| | | | | |
|---|---|---|---|---|
| CN | 104870324 | | 8/2015 | |
| EP | 1837293 | A1 * | 9/2007 | B65D 85/1045 |
| EP | 2594507 | A1 * | 5/2013 | B65D 5/0281 |
| EP | 2657926 | | 10/2013 | |
| EP | 2746190 | | 6/2014 | |
| EP | 2845498 | | 3/2015 | |
| JP | 10158608 | A * | 6/1998 | C09J 7/02 |
| JP | 3184144 | U * | 6/2013 | B65D 30/02 |
| JP | 2014/20137 | | 10/2014 | |
| WO | WO-2013068500 | A1 * | 5/2013 | B65D 85/1054 |
| WO | WO-2013076012 | A1 * | 5/2013 | B65D 5/0281 |
| WO | WO 2014/096427 | | 6/2014 | |

OTHER PUBLICATIONS http://www.bbc.co.uk/news/science-environment-19875247.
PCT/EP2016/070254 International Search Report and Written Opinion dated Oct. 10, 2016 (8 pages).
Office Action issued in China for Application No. 201680038108.7 dated Mar. 26, 2019 (13 pages). English translation included.

* cited by examiner

CONTAINER WITH IMPROVED CLOSING MECHANISM

This application is a U.S. National Stage Application of International Application No. PCT/EP2016/070254, filed Aug. 26, 2016, which was published in English on Mar. 9, 2017, as International Publication No. WO 2017/036991 A1. International Application No. PCT/EP2016/070254 claims priority to European Application No. 15182996.7, filed Aug. 28, 2015.

The present invention relates to a container for consumer goods having a housing and a lid movable relative to the housing being at least partially formed from one or more folded fiber-based laminar blanks. Containers according to the present invention find particular application as containers for smoking articles, such as cigarettes.

It is known to package elongate aerosol-generating articles and other consumer goods in containers formed from folded cellulose-fiber based laminar blanks. Elongate aerosol-generating articles, such as cigarettes and cigars, are commonly sold in hinge-lid packs having a box for housing the aerosol-generating articles and a lid connected to the box about a hinge line extending across the back wall of the container. The hinge-lid pack may also comprise an inner frame secured to an inner surface of the box, the inner frame having front and side walls against which the lid closes. Such packs are typically constructed from laminar cardboard blanks. In use, the lid is pivoted about the hinge line to open the pack and so gain access to the aerosol-generating articles held in the box.

In many cases, it is important to ensure that the lid remains in the closed position during normal handling, so that, for example, the consumer goods do not accidentally get exposed or fall out of the container. For aerosol-generating articles it can be particularly important that the lid remains tightly shut in the closed position, so that the freshness of the articles can be preserved.

Various mechanisms have been proposed for improving the interaction between the lid and the box of such containers, and in particular, for reducing the chances of the lid inadvertently moving away from the closed position during normal handling. For example, retention cuts may be provided on the inner frame for interacting with the lid. Alternatively, a temporary adhesive may be provided on the lid or the box. However, such mechanisms deteriorate and become less effective after several repetitions of opening and closing of the lid. Alternatively or additionally, the fibrous nature of the laminar blanks can make it difficult for a secure closure to be formed between the lid and the box. This can be particular problematic for containers containing aerosol-generating articles, where a consumer may need to open and close the lid on multiple occasions each time they access an individual aerosol-generating article. Other mechanism include magnetic-based mechanisms, such as those described in WO 201/096427 A1. However, these may be difficult to manufacture and/or relatively costly.

Furthermore, where an adhesive is provided on the lid or box loose material from the consumer goods—such as loose tobacco material from an aerosol-generating article—can become undesirably stuck to the adhesive during use of the container. This can result in an undesirable appearance of the container and a less effectively functioning closing mechanism. This can also create a gap that can allow air to pass into the container when the lid is in a closed position, which can result in the consumer goods losing freshness.

It would be desirable to provide a fiber-based container having an improved mechanism for reducing the chances of the lid inadvertently moving away from the closed position during normal handling. It would be further desirable to provide such a container having a mechanism that is less likely to deteriorate and become less effective after several repetitions of opening and closing of the lid. It would be particularly desirable to provide such a container that can be readily produced without significant modification of existing container designs or packaging equipment.

According to the present invention, there is provided a container for consumer goods, the container comprising a housing having an opening for accessing the consumer goods; and a lid connected to the housing and movable relative to the housing between a closed position in which the lid covers the opening and an open position in which the opening is uncovered. A first surface of the lid is disposed adjacent to a first surface of the housing when the lid is in the closed position, and a microsuction structure is provided on the first surface of the lid, the first surface of the housing, or both the first surface of the lid and the first surface of the housing, for retaining the lid in the closed position relative to the housing.

The term "microsuction structure" is used herein to refer to an article comprising a flexible material having a plurality of micro cavities on the material's external surface. The walls of the micro cavities are deformable, such that, when the external surface of the material is pressed against a contact surface, a sealed environment of reduced pressure is formed between the walls of the cavities and the contact surface. This provides a suction force between the walls of the cavities and the contact surface.

The micro cavities may have a diameter of from 5 microns to 300 microns. The material may be formed of an expanded resin having a plurality of internal air bubbles. The material may be provided as a layer of a sheet-like article on the surface of the container. The layer may have a thickness of from 30 microns to 500 microns. The sheet-like article may include one or more additional layers, such as a layer for securing the material layer to the surface of the container.

The microsuction structure can therefore provide an effective means for securing the lid in the closed position relative to the housing. Because the microsuction structure relies on the use of negative pressure for providing a closing force, rather than, for example, chemical adhesion, the microsuction structure is less likely to deteriorate and become less effective after several repetitions of opening and closing of the lid. Furthermore, because the microsuction structure can be provided in the form of a sheet like article, a container for consumer goods, such as a container for smoking articles, without significant modification of existing container designs or packaging equipment.

The present invention is particularly suited to containers for consumer goods, where the lid is hinged to the housing and pivots relative to the housing between a closed position in which the lid covers the opening and an open position in which the opening is uncovered. This is because the pivoting movement on opening of the container can result in the microsuction structure being peeled away from the contact surface without any noticeable resistance to the user of the container. On the other hand, when the lid is pivoted into the closed position relative to the housing the microsuction structure can form a strong engagement with its contact surface and thereby provide an effective retaining means, without requiring any extra or different closing action to be undertaken by the user of the container.

In some preferred embodiments a microsuction structure is provided on the first surface of the lid, and a microsuction structure is provided on the first surface of the housing. This can enhance the retention effect provided by the microsuction structures as they can attach to each other when the lid is in the closed position.

Alternatively, in some other preferred embodiments, the microsuction structure is provided on only one of the first surface of the lid or the first surface of the housing. This can be advantageous as it means that only one surface of the lid or housing needs to be modified to incorporate an additional element. The remaining surface may therefore remain unmodified. However, in some such embodiments, it can be preferable for the other of the first surface of the lid or the first surface of the housing to have a surface smoothness of 1.2 micrometers or less as measured in accordance with ISO 8791-4, preferably a surface smoothness of 0.8 micrometers or less as measured in accordance with ISO 8791-4. This can improve the interaction between the microsuction structure and the other first surface of the lid or the housing, and thereby improve the retention effect provided by the microsuction structure. This is particularly important when the container is formed from one or more folded fiber-based laminar blanks, since the fibrous nature of the blank will mean that it may not provide an inherently smooth contact surface for the microsuction structure to engage with. Accordingly, in such embodiments, it is preferable to provide the other of the first surface of the lid or the first surface of the housing with a surface smoothness of 1.2 micrometers or less as measured in accordance with ISO 8791-4, preferably a surface smoothness of 0.8 micrometers or less as measured in accordance with ISO 8791-4.

Such a surface smoothness may be provided by any suitable means. However, in some particularly preferred embodiments, the other of the first surface of the lid or the first surface of the housing comprises a varnish, such as an ultraviolet (UV) cured varnish. The varnish may be easy to apply locally to the other of the first surface of the lid or the first surface of the housing. This means that significant modification of the remainder of the container is not necessary, in order to ensure that the other of the first surface of the lid or the first surface of the housing has a desired smoothness of 1.2 micrometers or less.

The term "varnish" is used herein to refer to a substance that provides a continuous coating over a given surface. The varnish is typically transparent. The term "varnish" should not be confused with the likes of printed inks, where discrete ink dots are applied to a surface, thereby leaving areas of the surface uncovered.

Preferably, the microsuction structure is provided on the first surface of the lid, the first surface of the housing, or both the first surface of the lid and the first surface of the housing, by means of one or more labels. This can be a convenient and practical means for ensuring that the surface is provided with the microsuction structure, without needing to significantly modify the container.

Preferably, each of the one or more labels has a thickness of less than about 300 micrometers, more preferably a thickness of less than about 150 micrometers, even more preferably a thickness of less than about 50 micrometers. Preferably, each of the one or more labels has a thickness of at least about 20 micrometers. In some embodiments, each of the one or more labels has a thickness of at least about 60 micrometers. Ensuring that the thickness of each of the one or more labels is within the aforementioned ranges, eliminates the need for significant modification of the container dimensions.

In alternative embodiments, the microsuction structure may be integral with the first surface of the lid, the first surface of the housing, or both the first surface of the lid and the first surface of the housing.

Preferably, the force required to separate the lid from the housing when the lid is in the closed position is less than about 15 Newtons. This can ensure that the container is still relatively easy to open when a consumer wishes to access the consumer goods.

Preferably, the force required to separate the lid from the housing when the lid is in the closed position is at least about 2 Newtons, more preferably at least about 2 Newtons. This can reduce the likelihood of the lid accidentally being opened during normal handling of the container, for example, when the container is in a consumer's pocket.

Preferably, the microsuction structure covers a surface area of at least 1 centimeters squared on the first surface of the lid or the first surface of the housing, more preferably at least 3 centimeters squared on the first surface of the lid or the first surface of the housing. Preferably, the microsuction structure covers a surface area of less than 10 centimeters squared on the first surface of the lid or the first surface of the housing.

When the lid is in the closed position, the first surface of the lid is disposed adjacent to the first surface of the housing. This creates an overlapping area between the first surface of the lid and the first surface of the housing. Preferably, the microsuction structure covers a surface area of at least 25 percent of the surface area of the overlapping area between the first surface of the lid and the first surface of the housing. In some preferred embodiments the microsuction structure covers a surface area of 100 percent or less than the surface area of the overlapping area between the first surface of the lid and the first surface of the housing.

In some preferred embodiments, the embodiments the microsuction structure covers a surface area of 120 percent or more of the surface area of the overlapping area between the first surface of the lid and the first surface of the housing. Such embodiments can reduce the need for a consumer to accurately align the lid with the housing when closing the container.

The microsuction structure may be provided on the first surface of the lid, the first surface of the housing, or both the first surface of the lid and the first surface of the housing in any suitable arrangement. For example, the microsuction structure may be provided as a single continuous element. This may ease manufacture and assembly of the container. Alternatively, the microsuction structure may be provided as a plurality of elements, such as a plurality of strips. The plurality of elements may be arranged in a repeating pattern, or may be arranged randomly on the container. At least one of the plurality of elements may have a geometric shape, such as a square shape or an oval shape. Alternatively or additionally, at least one of the plurality of elements may have a shape representative of a character, such as a letter or number.

The housing and lid may have any suitable structure. However, in some particularly preferred embodiments, the housing comprises a box comprising: a box front wall, a box back wall, first and second box side walls, and a box bottom wall, and wherein the first surface of the housing is located on the box front wall.

In some such embodiments, the lid comprises a flap that is hinged to the box, the flap comprising a top flap portion that overlies the top of the box when the flap is in the closed position and a front flap portion that at least partly overlies the box front wall when the flap is in the closed position, and wherein the first surface of the lid is located on the inner surface of the front flap portion. Preferably, the box comprises a top wall at least partially defining the opening for accessing the consumer goods, in which the opening extends across the top wall from the front edge thereof and wherein the periphery of the opening is spaced apart from the rear edge and the side edges of the top wall so that the top wall extends around the rear and sides of the opening. Preferably, the opening also extends part way down the box front wall from the front edge of the box top wall, and when the flap is in the closed position, the front flap portion overlies the part of the opening that extends part way down the box front wall and also overlies at least a part of the overlies the box front wall.

In some other such embodiments, the lid may comprise a lid front wall, a lid back wall, first and second lid side walls, and a lid top wall, and wherein the first surface of the lid is located on the inner surface of the lid front wall. Preferably, the lid front wall comprises a lid front wall outer panel defining the outer surface of the lid front wall, and a lid front wall under panel defining the inner surface of the lid front wall. In such an embodiment, the lid front wall under panel depends from and underlies the lid front wall outer panel. This arrangement is particular advantageous for embodiments in which the container is formed from a folded laminar blank, and in which the first (inner front wall) surface of the lid is provided with a varnish, because the varnish can to be applied to the first (inner front wall) surface of the lid using existing manufacturing machinery and techniques.

In such embodiments, preferably the box comprises an inner frame, and a top portion of the box front wall is defined by the inner frame, and wherein the first surface of the housing is located on the inner frame. In such embodiments, preferably the inner frame comprises a front wall and the first surface of the housing is located on the front wall of the inner frame.

Preferably, the container contains a bundle of smoking articles within the housing.

Preferably, the container is formed from one or more folded laminar blanks.

Containers according to the present invention find application for consumer goods, in particular elongate consumer goods such as smoking articles.

Containers according to the present invention may be formed from at least one folded fiber-based laminar blanks, more preferably at least one cellulose-fiber-based laminar blank. The one or more folded laminar blanks may be formed from any suitable fiber-based material or combination of fiber-based materials, including, but not limited to, cardboard, paperboard, or combinations thereof. Preferably, the blank is a laminar cardboard or paperboard blank having a weight of between about 100 grams per square meter and about 350 grams per square meter, more preferably between about 100 grams per square meter and about 300 grams per square meter. In preferred embodiments, the blank has a thickness of from about 200 to about 400 micrometers, more preferably from 250 micrometers to 350 micrometers.

A "fiber-based laminar blank" is used herein to refer to a laminar blank made from fibrous material, and in particular one comprising at least 50 percent by weight of fibers, such as cellulose fibers, based on the total fiber content of the laminar blank.

A container according to the present invention may optionally comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

Further, the consumer articles may be provided within one such container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which consumer goods can be removed when a lid of the container is in a respective open position.

The container is preferably a rectangular parallelepiped container comprising two wider walls spaced apart by two narrower walls. A hinge lid container shall typically comprise two longitudinal rounded or bevelled edges on the front wall, and/or two longitudinal rounded or bevelled edges on the back wall. These may optionally be in combination with one or more rounded or bevelled transverse edges.

Where the container comprises bevelled edges, preferably the bevelled edges have a width of between about 1 mm and about 10 mm, preferably between about 2 and about 6 mm.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

The exterior surfaces of containers according to the invention may be printed, embossed, debossed or otherwise embellished with manufacturer or brand logos, trade marks, slogans and other consumer information and indicia.

As used herein the terms "side", "top", "bottom", "front", "back" and other terms used to describe relative positions of the components of containers according to the invention refer to the container in an upright position with the lid portion at the top and the box portion bottom wall at the bottom. When describing containers according to the present invention, these terms are used irrespective of the orientation of the container being described.

As used herein the term "hinge line" refers to a line about which two elements may be pivoted relative to each other. A hinge line may be, for example, a fold line, a perforation line or a score line in a wall or panel of the container. Where the hinge line is a perforation line, the perforation line may be used to remove parts of the container.

The term "panel" is used herein to refer to a portion of the container formed from a single, continuous portion of material. A panel may depend along one or more fold lines from one or more other panels. The term "flap" refers to a panel that depends along only one fold line from only one other panel.

The term "wall" refers more generally to a facet of the container, and a wall may be formed from a single panel or flap, or a wall may be formed from two or more abutting or overlapping panels or flaps.

The term "aerosol-generating article" is used herein to mean an article comprising at least one substrate that forms an aerosol when heated. As known to those skilled in the art, an aerosol is a suspension of solid particles or liquid droplets in a gas, such as air. The aerosol may be a suspension of solid particles and liquid droplets in a gas, such as air. For example, the aerosol-generating article may be an article for use in an electrically operated smoking system. In this case, the aerosol-generating article may comprise a tobacco or other nicotine-containing substrate that generates an aerosol comprising nicotine when the substrate is heated. Alternatively, the aerosol-generating article may comprise a more conventional smoking article, such as a filter cigarette.

The invention will be further described, by way of example, with reference to the drawings in which.

Figure 1:
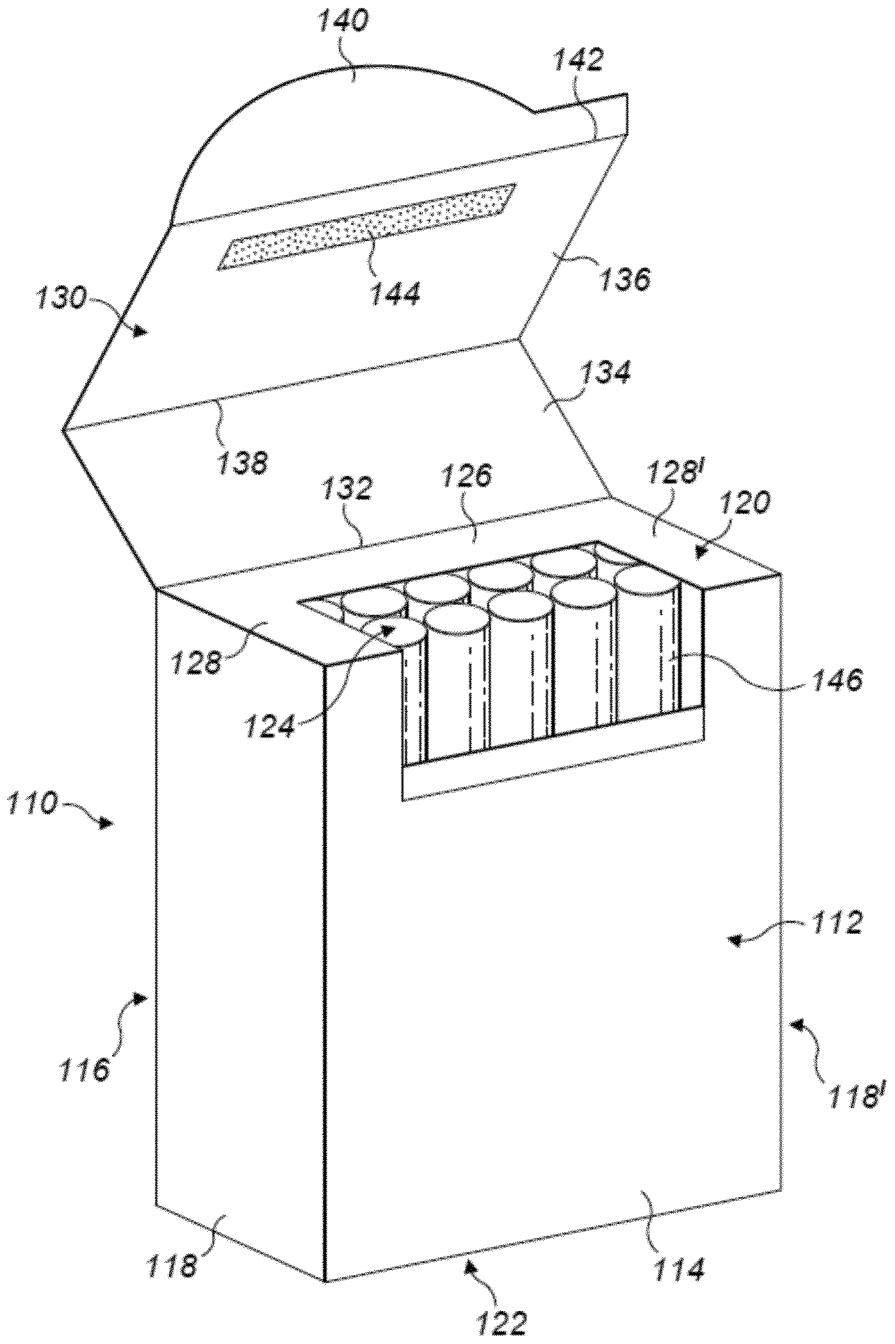
FIG. 1 is an isometric view a container for consumer goods, according to a first embodiment of the present invention.

The container 110 of the embodiment of FIG. 1 is a pack for cigarettes. It comprises a box 112 having a front wall 114, a rear wall 116 (not visible in FIG. 1) opposed to the front wall and side walls 118, 119 (only one of which is visible in FIG. 1) connecting the front wall to the rear wall, a top wall 120 and a bottom wall 122 (not visible in FIG. 1). An opening 124 extends part way across the front portion of the top wall 120 and part way down the front wall 114. Rear 126 and side 128, 128' margins of the top wall remain and define that part of the opening 124 in the top wall. The opening extends down 25% of the height of the front wall 114; this proportion can be changed depending on the size of the package in relation to the goods carried in the package. In the embodiment of FIG. 1, the opening extends across about ⅔ of the width of the package; again, this proportion can be changed depending on the size of the package in relation to the goods carried in the package.

A closure flap 130 extends from the rear wall 16 of the package and is hinged to the rear edge 132 of the top wall 120. The closure flap consists of a top wall closure panel 134 extending from the rear wall 116 of the pack, from which a front wall closure panel 136 extends along a fold 138. A tab 140 extends from the front wall closure panel 136 along fold 142. A microsuction structure 144 is provided on the inner surface of the front wall closure panel 136.

In use of the container 110, a consumer holds the tab 138 of the flap 130 of the closed container and hinges it upwards, unsealing the connection made between the microsuction structure 144 and the outer surface of the box front wall 114. This uncovers the opening 124 and allows a cigarette 146 to be removed from the container. The pack is closed by hinging the top wall panel 134 of the flap onto the top wall 120 and then hinging the front wall panel 136 of the flap onto the front wall 114 of the package to close the opening 124. The application of pressure to the outer surface of the front wall closure panel 136 causes the microsuction structure 144 to engage with the box front wall 114, and thereby retain the flap 130 in the closed position.

Figure 2:
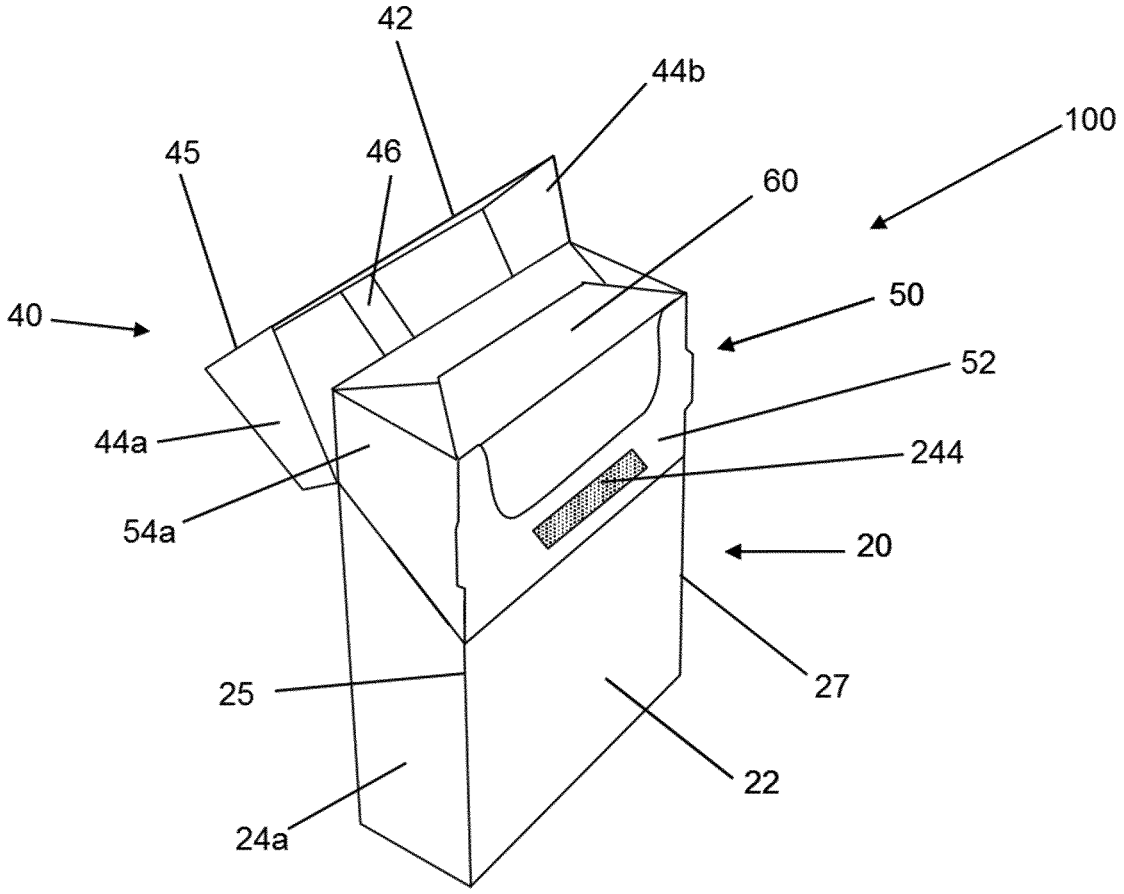
FIG. 2 is an isometric view a container for consumer goods, according to second first embodiment of the present invention.

FIG. 2 shows a container 100 for consumer goods, according to second first embodiment of the present invention, where the container 100 is in an open condition. The container 100 contains a wrapped bundle of consumer goods 60, such as a bundle of cigarettes. The container is formed from a folded laminar blank and has a lid portion 40 and a box portion 20. The lid portion has a first lid side wall 44*a*, a second lid side wall 44*b*, and a lid top wall 46. The lid portion also has a lid front wall 42 and a lid back wall (not shown). The box portion 20 has a box front wall 22, and a first box side wall 24*a*. The box portion 20 also has a box bottom wall, a box back wall and a second box side wall (not shown). The lid 40 depends along a hinge line (not shown) from a top edge of the box back wall, and is movable about the hinge line between an open position (as shown in FIG. 2) and a closed position (not shown). An inner frame 50 is attached to the inside of the box 20 and includes a first inner frame side wall (54*a*), a second inner frame side wall (not shown), and an inner frame front wall 52.

A microsuction structure 244 is provided on the outer surface of the inner frame front wall 52, and is configured to engage with the inner surface of the lid front wall 45 to retain the lid portion 40 in a closed position relative to the box portion 20. In particular, to close the container the consumer pivots the lid portion 40 about the hinge relative to the box portion 20, until the inner surface of the lid front wall 42 is adjacent to the outer surface of the inner frame front wall 52. The application of pressure to the outer surface of the lid front wall 42 causes the microsuction structure 244 on the inner frame front wall 52 to engage with the inner surface of the lid front wall 42, and thereby retain the lid portion 40 in the closed position.

The invention claimed is:

1. A container for consumer goods, the container being at least partially formed from one or more fiber-based laminar blanks, the container comprising:

a housing having an opening for accessing the consumer goods; and a lid connected to the housing and movable relative to the housing between a closed position in which the lid covers the opening and an open position in which the opening is uncovered, wherein a first surface of the lid is disposed adjacent to a first surface of the housing when the lid is in the closed position, and wherein a microsuction structure is provided on only one of the first surface of the lid or the first surface of the housing, for retaining the lid in the closed position relative to the housing, and wherein the other of the first surface of the lid or the first surface of the housing has a surface smoothness of 1.2 micrometers or less as measured in accordance with ISO 8791-4.

2. A container according to claim 1, wherein the other of the first surface of the lid or the first surface of the housing comprises a varnish.

3. A container according to claim 1, wherein the microsuction structure is provided on the first surface of the lid, the first surface of the housing, or both the first surface of the lid and the first surface of the housing, by one or more labels.

4. A container according to claim 3, wherein each of the one or more labels has a thickness of less than about 300 micrometers.

5. A container according to claim 1, wherein the force required to separate the lid from the housing when the lid is in the closed position is less than about 15 Newtons.

6. A container according to claim 1, wherein the force required to separate the lid from the housing when the lid is in the closed position is at least about 2 Newtons.

7. A container according to claim 1, wherein the microsuction structure covers a surface area of at least 1 centimeters squared on the first surface of the lid or the first surface of the housing.

8. A container according to claim 7, wherein the lid comprises a flap that is hinged to the box, the flap comprising a top flap portion that overlies the top of the box when the flap is in the closed position and a front flap portion that at least partly overlies the box front wall when the flap is in the closed position, and wherein the first surface of the lid is located on the inner surface of the front flap portion.

9. A container according to claim 1, wherein the housing comprises a box comprising: a box front wall, a box back wall, first and second box side walls, and a box bottom wall, and wherein the first surface of the housing is located on the box front wall.

10. A container according to claim 1, wherein the lid comprises a lid front wall, a lid back wall, first and second lid side walls, and a lid top wall, and wherein the first surface of the lid is located on the inner surface of the lid front wall.

11. A container according to claim 10, wherein the box comprises an inner frame, and a top portion of the box front wall is defined by the inner frame, and wherein the first surface of the housing is located on the inner frame.

12. A container according to claim 1, containing a bundle of smoking articles within the housing.

13. A container according to claim 1, wherein the container is formed from one or more folded laminar blanks.

* * * * *